US006959549B2

(12) United States Patent
Tilston

(10) Patent No.: US 6,959,549 B2
(45) Date of Patent: Nov. 1, 2005

(54) MICRO-POWER UNIT

(75) Inventor: John Ronald Tilston, Farnborough (GB)

(73) Assignee: QinetiQ Limited (GB)

( * ) Notice: Subject to any disclaimer, the term of this patent is extended or adjusted under 35 U.S.C. 154(b) by 175 days.

(21) Appl. No.: 10/489,471

(22) PCT Filed: Sep. 12, 2002

(86) PCT No.: PCT/GB02/04168

§ 371 (c)(1),
(2), (4) Date: Mar. 11, 2004

(87) PCT Pub. No.: WO03/025351

PCT Pub. Date: Mar. 27, 2003

(65) Prior Publication Data

US 2004/0250545 A1 Dec. 16, 2004

(30) Foreign Application Priority Data

Sep. 21, 2001 (GB) ..... 0122797

(51) Int. Cl.[7] ..... F01K 25/08
(52) U.S. Cl. ..... 60/651; 60/671
(58) Field of Search ..... 60/651, 670, 671

(56) References Cited

U.S. PATENT DOCUMENTS 3,148,508 A 9/1964 Karig
3,339,663 A 9/1967 Anderson
3,393,515 A 7/1968 Tabor et al.
3,672,048 A 6/1972 Conwell
3,845,628 A 11/1974 Bronicki et al.
3,861,150 A 1/1975 Lear
3,894,395 A * 7/1975 Laing ..... 60/652
3,928,974 A * 12/1975 Benson ..... 60/650
4,044,558 A * 8/1977 Benson ..... 60/520
4,526,013 A 7/1985 Joy
4,851,722 A * 7/1989 Zauderer ..... 310/11
5,932,940 A 8/1999 Ananthasuresh et al.

FOREIGN PATENT DOCUMENTS

WO WO 96/04516 2/1996

* cited by examiner

*Primary Examiner*—Hoang Nguyen
(74) *Attorney, Agent, or Firm*—McDonnell Boehnen Hulbert & Berghoff LLP

(57) ABSTRACT

A micro power unit comprises a Rankine cycle circuit powered by combustion of hydrocarbon fuel from tank (2). Combustion takes place on a combustion catalyst (6) in a chamber (5). The fluid circuit includes a boiler (10), turbine (11), a condenser (12) and feed pump (13). The feed pump impeller (13A) is driven by magnetic coupling with the turbine rotor (11A) and further magnetic couplings may be used to drive e.g. a propeller (15) for a micro air vehicle and/or electrical generator (16).

19 Claims, 2 Drawing Sheets

Figure 1:
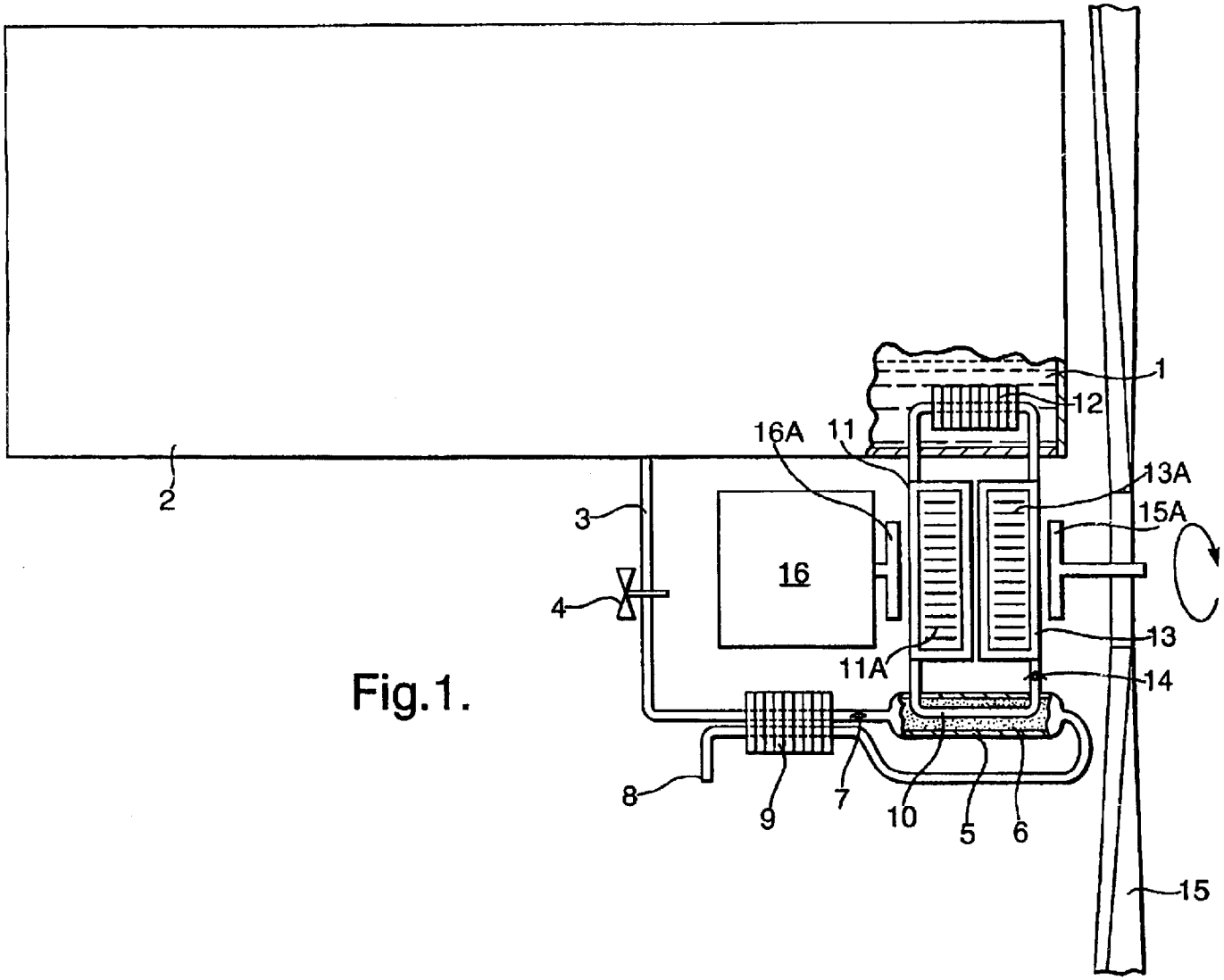

P
1
2
3
4
V

MICRO-POWER UNIT

This invention relates to power units and more particularly to power units for use in applications where small scale and/or weight are major considerations. One such application to which the present invention may be directed is in micro air vehicles and/or model aeroplanes. Other such applications include for use in portable electrical articles such as lap-top computers, music players, audio-visual players, telephones and the like.

Conventionally, chemical cells or batteries have been used to provide a power source in micro air vehicles and the like. Whilst a generally well tested and reliable power source, batteries suffer from a number of disadvantages. Firstly they comprise a chemically intensive construction raising safety and environment issues in both their manufacture and disposal. The safety precautions which must be employed in manufacture and disposal and the relative rarity of the chemicals used in such batteries render them relatively expensive.

The energy density of the highest energy density batteries can approach that of TNT and that, combined with the safety issues associated with the chemical power sources used, can result in such batteries being categorised as munitions under the Geneva Convention. This renders these power sources far less freely available for wide range sale and use.

A further disadvantage of batteries, particularly when used in flight applications, is the parasitic weight of the power source. Since there is no consumption of chemicals in battery sources, merely conversion, the weight of a spent battery is substantially the same as a fully charged battery. This weight becomes dead weight when it is producing no benefit to a flying application.

The construction of conventional battery power sources is such that they are able to deliver either high power of a short duration, or low power over a longer duration. Hence they are not as flexible as may be desirable for some applications.

Hydrocarbon fuel based power supplies have been considered as possible alternative sources of power in applications such as micro aircraft. An example is the micro gas turbine engine described in U.S. Pat. No. 5,932,940. Such power supplies have tended to suffer poor performance in thermal efficiency and power generation and to date it has proven difficult to manufacture such a supply which is sufficiently small yet sufficiently effective to be efficient for use in applications such as micro air flight. U.S. Pat. No. 5,932,940 also discloses a heat pump or power generator based on the Rankine Cycle and comprising a microevaporator, microturbine, microcondenser and micropump.

The present invention aims to alleviate at least some of the previously described problems and disadvantages identified for the prior art.

In accordance with the present invention, there is provided a micro power unit comprising a supply of hydrocarbon fuel in a fuel tank; means for combusting fuel from said tank; means for exhausting the combustion products from said combusting means; and means defining a Rankine cycle fluid circuit comprising; a boiler for evaporating working fluid, heated by the combusting means; a turbine driven by vapour from the boiler; means for considering working fluid from the turbine; and a feed pump driven by the turbine for supplying condensate from the condensing means to the boiler, characterised in that the turbine and feed pump comprise respective rotating parts coupled together magnetically.

The unit is conveniently manufactured on a scale having dimensions of the order of 10 s to 100 s of mm. In one example, it may have a maximum dimension of about 80–100 mm with the Rankine cycle fluid circuit having a maximum dimension of around 20–40 mm.

Magnetic coupled between the rotating parts of the turbine and feed pump is of particular advantage in avoiding the need for sealed shafts penetrating the turbine and pump casings. Any known magnetic materials may be employed in the manufacture of the rotating parts of the turbine and feed pump but are selected based on their resistance to corrosion in the surrounding fluid environment and their structural ability to cope with loads carried in operating at the selected power output. One potentially useful form is a multi-pole magnetic disc (typically having an NdFeB composition). Pairs of such discs may be aligned with their opposing poles in alignment, providing secure coupling arrangements. The casings of the turbine and pump through which the magnetic coupling flux must pass may be of e.g. stainless steel.

Conveniently, power take-offs from the unit may also comprise magnetised materials and may equally be coupled to a rotating part of the turbine or feed pump magnetically. Power take-offs may be, for example, to a propeller for propulsion of a micro aircraft, or an electrical generator, or both. Power units according to the invention are intended for providing a power supply of the order of 10–15 W but could be scaled to provide supplies at much smaller power ratings if desired.

Optionally, the fluid circuit is arranged such that the condensing means is positioned above the boiler in the normal start up position of the unit. This arrangement makes use of gravity to feed cold working fluid to the boiler to produce an unassembled start and removes the need for a separately powered feed pump. Alternatively a wick or other capillary action device may be located in the boiler, configured to retain a sufficient supply of fluid to provide for start up of the unit.

Preferably the Rankine cycle fluid circuit incorporates a non-return valve to promote one-way flow of working fluid about the fluid circuit. Preferably, the fluid circuit has a larger volume adjacent the turbine than is found adjacent the boiler. This encourages flow of the fluid towards the turbine and assists in maintaining a one way flow of fluid about the circuit. Conveniently, the working fluid is water, although any fluid which is suitably robust to evaporation/condensation cycles without degradation of its structure may be used. Other examples include refrigerants, such as halon and freon, or lower hydrocarbons such as propene or butane.

Optionally, the unit further comprises a speed or voltage sensor for monitoring the power output of the unit when in operation. Once a pre-determined power is detected, a load can be switched into the unit. Optionally, the unit incorporates a control system for monitoring and/or adjusting fuel flow to the combusting means to maintain a target power output.

Suitable hydrocarbon fuels include, but are not strictly limited to, gasoline, propane, butane, pentane, methanol and mixtures containing any or all of these. Many lower hydrocarbons having up to about 6 to 12 carbon atoms per molecule may equally be used for this application, either individually or in mixtures. The fuel source is typically self pressurised, but optionally a pump may be provided to pressurise the fuel. Conveniently, air is use as a combustion agent. However, when the unit is to be used when sufficient air is not available, a dedicated oxidant may be used. Examples of suitable dedicated oxidants which may be used include oxygen and hydrogen peroxide.

Desirably, fuel is supplied from the tank via a control valve so that the power output can be regulated and/or adjusted. Preferably, the combusting means comprises a combustion chamber provided with a combustion catalyst. The catalyst is desirably attached to or lined on the inner walls of the combustion chamber. One example of a suitable combustion catalyst is platinum black which is desirably provided on a refractory fibre support.

Figure 2:
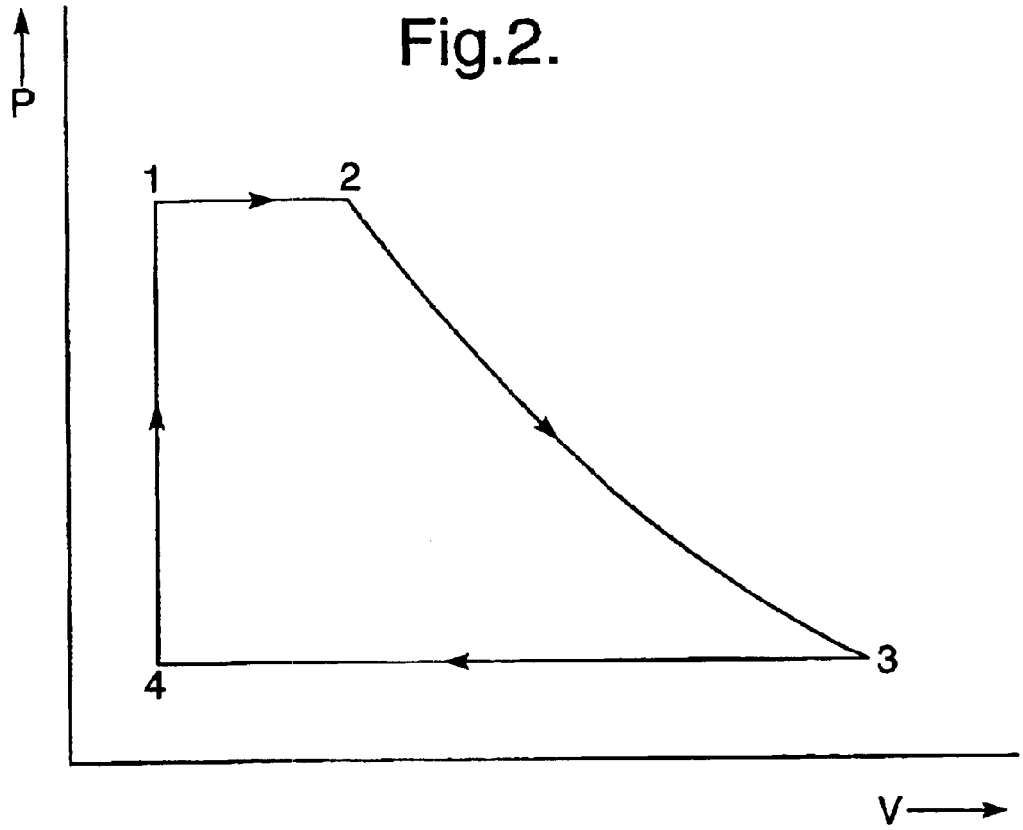

For the purposes of exemplification, an embodiment of the invention will now be described in more detail with reference to the following figures in which:

FIG. 1 illustrates schematically an embodiment of a micro power unit according to the invention for use in a micro air vehicle; and FIG. 2 illustrates the thermodynamic cycle utilised by the unit.

Referring to FIG. 1, a liquefied hydrocarbon fuel 1 such as propane or butane is carried in a tank 2. The fuel is self-pressurised so there is no requirement for a fuel pump in this embodiment. The fuel flows through a supply tube 3 and a control valve 4. The control valve is used to regulate and adjust power output. Downstream of the valve, the supply tube is provided with sufficient length to ensure that the liquid fuel is largely evaporated so that gaseous fuel is delivered to the combustion chamber 5. The combustion chamber carries on its inner wall a catalyst such as platinum black on a refractory fibre support (schematically indicated at 6) to maximise heat transfer into the wall. Air for combustion can be entrained through inlets 7 by the fuel gas jet entering the combustion chamber. This is convenient because it provides a self-regulating fuel-air mixture (in the manner of a Bunsen burner or carburetor). The cooled combustion products are exhausted from the system at 8 after being exchanged with incoming fuel in a heat exchanged 9 in order to maximise thermal efficiency.

Components in the Rankine cycle fluid circuit of the unit include a boiler 10, turbine 11, condensing heat exchanged 12, feed pump 13 and non-return valve 14. Water is used as a working fluid. The turbine rotor 11A and feed pump impeller 13A are manufactured from magnetised material and are coupled together magnetically, as are the power take-offs, in this case to a propeller 15 via a magnetised disc 15A coupled to the pump impeller and to an electrical generator 16 via a magnetised disc 16A coupled to the turbine rotor.

It will be noted that the orientation of the water circuit is such that, during operation, the cold side (feed water) is at the top of the loop and the boiler at the bottom. This is because, in the absence of a separately powered feed pump, it is necessary for gravity to provide the water in the boiler in order to produce an unassisted start, in the alternative, sufficient water may be retained on a wick, or similar capillary action device, in the boiler to provide for start-up. The motor could then be started from any orientation.

The general operation of the unit is now described. The control valve 4 opens to provide maximum fuel flow for a fast start-up. Fuel-air mixture lights on the catalyst in the combustion chamber 5. The heat evolved is heat exchanged into the water in the boiler 10 and the water boils. The steam produced flows up the circuit to drive the turbine 11, it is compelled to flow this way round the circuit by a combination of a larger circuit volume on the turbine side of the circuit and the non-return valve 14. Downstream of the turbine 11, the steam is condensed by heat exchange 12 with the fuel supply. This is partly to improve cycle efficiency and partly to counteract reducing fuel temperature due to latent heat of evaporation. The liquid water is then pumped back towards the boiler by the feed pump 13. A speed or voltage sensor (not shown) may be incorporated which can switch the load in when the unit has reached a satisfactory power output. After a few cycles, the bulk of the water is in liquid form in the condenser and the motor has accelerated close to a predetermined speed. A cycle pressure ratio of about 10:1 is achievable. A speed sensitive control system (not shown) may be incorporated to adjust the fuel flow to maintain the target speed.

FIG. 2 shows the thermodynamic cycle of the device on axes of pressure P (vertical) versus volume V (horizontal). Points 1–2 represent evaporation of the working fluid in the boiler 10; points 2–3 expansion of the fluid through the turbine 11; points 3–4 condensation in the heat exchanger 12; and points 4-1 return of condensate up to the boiler pressure by the feed pump 13.

Although not shown in the Figures, superheating of the steam from the boiler 10 might also take place, by routing the outlet from the boiler back through the combustion chamber 5 before passing to the turbine 11.

It is to be understood that the embodiment described with references to the Figures is exemplary of the invention and not intended to restrict the scope of the invention as claimed in the appended claims.

What is claimed is:

1. A micro power unit comprising: a supply of hydrocarbon fuel in a fuel tank; a combustor for combusting fuel from said tank; an exhaust for exhausting the combustion products from said combustor; and a Rankine cycle fluid circuit comprising: a boiler for evaporating working fluid, heated by the combustor; a turbine driven by vapour from the boiler; a condenser for condensing working fluid from the turbine; and a feed pump driven by the turbine for supplying condensate from the condenser to the boiler; the turbine and feed pump comprising respective rotating parts coupled together magnetically.

2. A micro power unit as claimed in claim 1 having a maximum dimension no more than approximately 100 mm and wherein the fluid circuit has a maximum dimension in the range of approximately 20 mm to approximately 40 mm.

3. A micro power unit as claimed in claim 1 comprising a power take-off device coupled magnetically to a rotating part of the turbine or feed pump.

4. A micro power unit as claimed in claim 3 wherein the power take-off device comprises a propeller and/or electrical generator.

5. A micro power unit as claimed in claim 1 wherein the combustor comprises a combustion chamber provided with a combustion catalyst.

6. A micro power unit as claimed in claim 5 wherein the catalyst is platinum black.

7. A micro power unit as claimed in claim 5 wherein the catalyst is provided on a refractory fibre support.

8. A micro power unit as claimed in claim 1 wherein the fluid circuit is arranged such that the condenser is located above the boiler in the normal start up position of the unit.

9. A micro power unit as claimed in claim 1 wherein working fluid is provided to the boiler by capillary action for start up of the unit.

10. A micro power unit as claimed in claim 1 wherein the condenser comprises a heat exchanger between the fluid circuit and fuel within the fuel tank.

11. A micro power unit as claimed in claim 1 wherein combustion products from the combustor are exhausted through a heat exchanger whereby to heat fuel in its passage from the fuel tank to the combustor.

12. A micro power unit as claimed in claim 1 wherein the fluid circuit incorporates a non-return valve to promote one-way flow of working fluid around the circuit.

13. A micro power unit as claimed in claim 1 wherein the working fluid is water.

14. A micro power unit as claimed in claim 1 wherein the hydrocarbon fuel comprises methanol, gasoline, propane, butane and/or pentane.

15. A micro power unit as claimed in claim 1 comprising a supply of fuel oxidant other than ambient air.

16. A micro power unit as claimed in claim 1 comprising a monitor of the power output of the unit for connecting a load to the unit when a predetermined power is generated.

17. A micro power unit as claimed in claim 1 comprising a control valve between the fuel tank and combustor whereby the power output of the unit can be regulated and/or adjusted.

18. A micro power unit as claimed in claim 6 wherein the catalyst is provided on a refractory fibre support.

19. A micro power unit comprising: a supply of hydrocarbon fuel in a fuel tank means for combusting fuel from said tank; means for exhausting the combustion products from said combusting means; and means defining a Rankine cycle fluid circuit comprising: a boiler for evaporating working fluid, heated by the combusting means; a turbine driven by vapour from the boiler; means for condensing working fluid from the turbine; and a feed pump for supplying condensate from the condensing means to the boiler characterized in that the turbine and feed pump comprise respective rotating parts coupled together magnetically.

* * * * *